US011787176B2

(12) United States Patent
Johnson

(10) Patent No.: US 11,787,176 B2
(45) Date of Patent: Oct. 17, 2023

(54) LIQUID EJECTION HEAD, METHOD OF OPERATING LIQUID EJECTING HEAD, AND LIQUID EJECTION APPARATUS

(71) Applicant: CANON KABUSHIKI KAISHA, Tokyo (JP)

(72) Inventor: Michiko Johnson, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 17/538,032

(22) Filed: Nov. 30, 2021

(65) Prior Publication Data

US 2022/0169024 A1 Jun. 2, 2022

(30) Foreign Application Priority Data

Dec. 2, 2020 (JP) ..... 2020-200522

(51) Int. Cl.
*B41J 2/14* (2006.01)

(52) U.S. Cl.
CPC ..... *B41J 2/14145* (2013.01)

(58) Field of Classification Search
CPC ..... B41J 2/1404; B41J 2/14; B41J 2/14145; B41J 2202/12
See application file for complete search history.

(56) References Cited

U.S. PATENT DOCUMENTS

| | | | | |
|---|---|---|---|---|
| 10,562,305 | B2 * | 2/2020 | Saito | B41J 2/155 |
| 10,696,050 | B2 * | 6/2020 | Takada | B41J 2/01 |
| 11,571,890 | B2 * | 2/2023 | Kishikawa | B41J 2/1601 |
| 2019/0009561 | A1 | 1/2019 | Mukoyama | |

FOREIGN PATENT DOCUMENTS

| | | | |
|---|---|---|---|
| CN | 1473708 | A | 2/2004 |
| CN | 1608853 | A | 4/2005 |
| CN | 102177025 | A | 9/2011 |
| CN | 106183424 | A | 12/2016 |
| CN | 107636457 | A | 1/2018 |
| CN | 109572221 | A | 4/2019 |
| JP | 2000141685 | A | 5/2000 |
| JP | 2014012353 | A | 1/2014 |

* cited by examiner

*Primary Examiner* — An H Do
(74) *Attorney, Agent, or Firm* — Canon U.S.A., Inc. I.P. Division

(57) ABSTRACT

A liquid ejection head includes a plurality of flow paths. The plurality of flow paths includes a first flow path through which a first liquid flows and a second flow path disposed adjacent to the first flow path. A second liquid, having higher average spectral reflectance at a wavelength in a visible light region than the first liquid, flows through the second flow path. When pressure is applied to the first liquid, the pressure applied to the first liquid in the first flow path is lower than pressure applied to the second liquid in the second flow path.

19 Claims, 10 Drawing Sheets

LIQUID EJECTION HEAD, METHOD OF OPERATING LIQUID EJECTING HEAD, AND LIQUID EJECTION APPARATUS

BACKGROUND

Field

The present disclosure relates to a liquid ejection head that ejects a plurality of types of liquids having different colors, a method of operating the liquid ejecting head, and a liquid ejection apparatus including the liquid ejection head.

Description of the Related Art

Some liquid ejection heads that eject liquids from ejection orifices to perform recording on a recording medium include a liquid ejection head having a plurality of ejection orifices to eject different types of liquids, for example, different colors of ink from the plurality of ejection orifices. In such a liquid ejection head, when liquids of different colors are mixed, image quality perceptually recognized in an image recorded on a recording medium may decrease. In the following description, a decrease in image quality refers to perceptually recognized deterioration of an image recorded by ejection. In order to suppress a decrease in image quality, Japanese Patent Application Laid-Open No. 2014-12353 discloses controlling the order of wiping ejection orifices in a wiping operation of wiping a liquid adhering to the peripheries of the ejection orifices. In the control described in Japanese Patent Application Laid-Open No. 2014-12353, a perceptible change in a color is smaller when a small amount of liquid of a bright color is mixed with a liquid of a dark color than when a small amount of liquid of the dark color is mixed with a liquid of the bright color, and thus, an ejection orifice corresponding to the liquid of the bright color is wiped first.

The method described in Japanese Patent Application Laid-Open No. 2014-12353 can suppress a decrease in image quality due to mixing of a liquid adhering to the periphery of an ejection orifice, but cannot suppress a decrease in image quality when liquids are mixed inside the ejection orifice or in a flow path communicating with the ejection orifice.

SUMMARY

According to an aspect of the present disclosure, a liquid ejection head includes a plurality of flow paths, wherein the plurality of flow paths includes a first flow path through which a first liquid is to flow, and a second flow path disposed adjacent to the first flow path and through which a second liquid, having higher average spectral reflectance at a wavelength in a visible light region than the first liquid, is to flow, and wherein, when pressure is applied to the first liquid, the pressure applied to the first liquid in the first flow path is lower than pressure applied to the second liquid in the second flow path.

Further features of the present disclosure will become apparent from the following description of exemplary embodiments with reference to the attached drawings.

DESCRIPTION OF THE EMBODIMENTS

Figure 1:
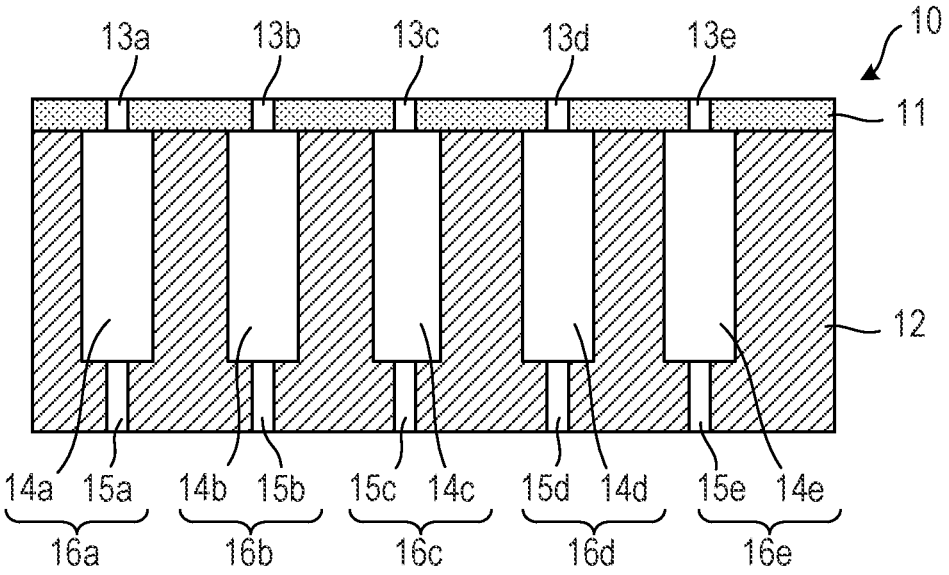
FIG. 1 is a schematic cross-sectional view illustrating a liquid ejection head according to a first embodiment.

Disclosed herein is a liquid ejection head, a method of operating the liquid ejection head, and a liquid ejection apparatus, which are capable of suppressing a decrease in image quality even when liquids of different colors are mixed in a flow path extending to an ejection orifice. In an example, when a first liquid and a second liquid having higher average spectral reflectance at a wavelength in a visible light region than the first liquid are caused to flow through a first flow path and a second flow path adjacent to the first flow path in a liquid ejection head, pressure applied to the second liquid in the second flow path is higher than pressure applied to the first liquid in the first flow path.

Next, embodiments of the present disclosure will be described with reference to the drawings. The embodiments described below are merely for describing the present disclosure, and do not limit the present disclosure. Common reference numerals are given to elements common to a plurality of drawings.

First Embodiment

FIG. 1 schematically illustrates a liquid ejection head 10 according to a first embodiment of the present disclosure. The liquid ejection head 10 is configured by laminating and joining a plurality of plate-shaped members. In the illustrated example, an ejection orifice forming member 11 and a liquid chamber forming member 12, both of which are plate-shaped members, are laminated and joined to each other. In the ejection orifice forming member 11, a plurality of ejection orifices 13*a* to 13*e* is formed as through holes. The liquid chamber forming member 12 is provided with liquid chambers 14*a* to 14*e* that communicate with the ejection orifices 13*a* to 13*e*, respectively, and hold liquids to be ejected from the ejection orifices 13*a* to 13*e*, that is, liquids to be ejected. In the liquid chamber forming member 12, supply paths 15*a* to 15*e* for supplying the liquids to the liquid chambers 14*a* to 14*e* are further formed so as to extend to the side opposite to the ejection orifices 13*a* to 13*e*. The liquid chambers 14*a* to 14*e* and the supply paths 15*a* to 15*e* constitute flow paths 16*a* to 16*e*. The shapes and dimensions of the ejection orifices 13*a* to 13*e* are the same, and the shapes and dimensions of the flow paths 16*a* to 16*e* are the same. The flow paths 16*a* to 16*e* are in contact with a joint interface between the ejection orifice forming member 11 and the liquid chamber forming member 12.

The liquid ejection head 10 according to the present embodiment ejects liquids of a plurality of different colors, for example, ink, onto a recording medium such as paper to perform recording with a color image. When recording is performed with a color image, a liquid of black (B) as well as liquids of three colors of yellow (Y), cyan (C), and magenta (M) are usually used as recording liquids. These four colors, that is, four types of liquids are also used in the liquid ejection head 10 according to the present embodiment. A cyan liquid is supplied to the flow path 16*a*, a black liquid is supplied to the flow paths 16*b* and 16*d*, a magenta liquid is supplied to the flow path 16*c*, and a yellow liquid is supplied to the flow path 16*e*.

Figure 2A:
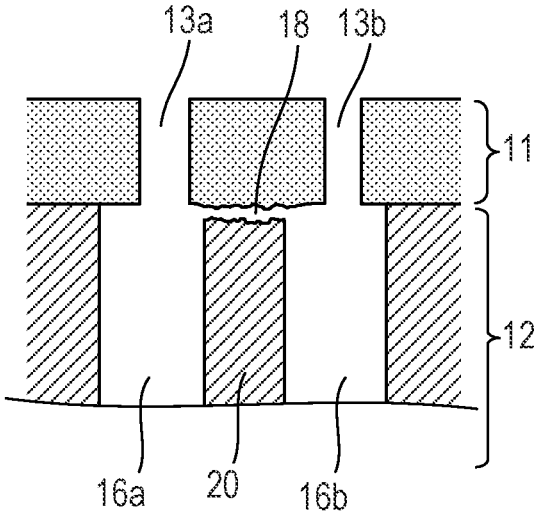
FIGS. 2A and 2B are schematic diagrams illustrating the flow of liquids in the liquid ejection head illustrated in FIG. 1.
Figure 2B:
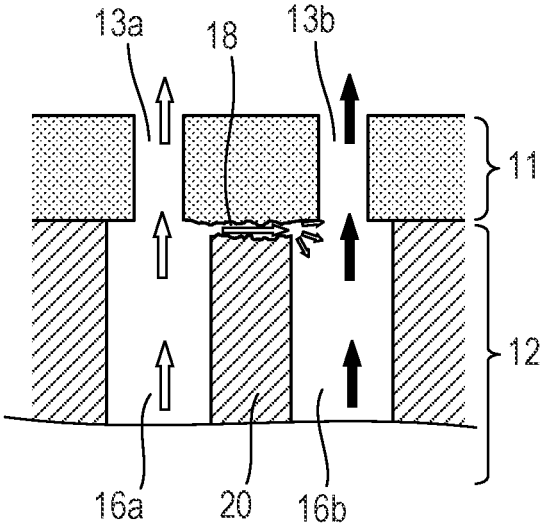

FIGS. 2A and 2B are diagrams illustrating the flow of liquids, focusing on a relationship between two adjacent flow paths in the liquid ejection head 10. In FIGS. 2A and 2B, the flow path 16*a* for a cyan liquid and the flow path 16*b* for a black liquid are illustrated as the two adjacent flow paths, and a white arrow indicates the flow of a cyan liquid and a black arrow indicates the flow of a black liquid. In the liquid chamber forming member 12, a portion disposed between the adjacent flow paths 16*a* and 16*b* is a partition wall 20 separating the flow paths 16*a* and 16*b*. Although the ejection orifice forming member 11 and the liquid chamber forming member 12 are joined, a minute defect 18 through which the flow paths 16*a* and 16*b* communicate with each other is likely to be formed at the joint interface, as illustrated in FIG. 2A. When the defect 18 is present, there is a possibility that the liquids in the flow paths 16*a* and 16*b* may flow to and be mixed with each other through the defect 18. That is, the cyan liquid in the flow path 16*a* and the black liquid in the flow path 16*b* may be mixed via the defect 18. Although the defect 18 is formed at the joint interface between the ejection orifice forming member 11 and the liquid chamber forming member 12 in this example, a defect through which the liquids can pass may occur in the partition wall 20 itself due to deterioration of the partition wall 20 separating the adjacent flow paths 16*a* and 16*b*.

When the defect 18 occurs, and a small amount of the black liquid flows into the cyan liquid, a perceptible change when a user observes an image formed by ejecting the cyan liquid is large. On the other hand, even when a small amount of the cyan liquid flows into the black liquid, there is almost no perceptible change when the user observes an image formed by ejecting the black liquid. Therefore, in the present embodiment, when there is a possibility that liquids of different colors may be mixed, the flow direction of the liquid at the defect 18 is controlled such that the perceptible change in the recorded image when the color mixture occurs is smaller. Specifically, as illustrated in FIG. 2B, the cyan liquid permeates and flows in the defect 18 from the flow path 16*a* toward the flow path 16*b*, and the black liquid does not flow in the opposite direction. As a method of allowing a liquid to flow only in one direction as described above, it is possible to set pressure applied to the cyan liquid in the flow path 16*a* to be higher than pressure applied to the black liquid in the flow path 16*b*, for example. In the example illustrated here, pressure applied to the liquids in the flow paths 16*a* and 16*b* is pressure applied to the liquids in the liquid chambers 14*a* and 14*b* provided at positions where the flow paths 16*a* and 16*b* communicate with the ejection orifices 13*a* and 13*b*, respectively.

Figure 3A:
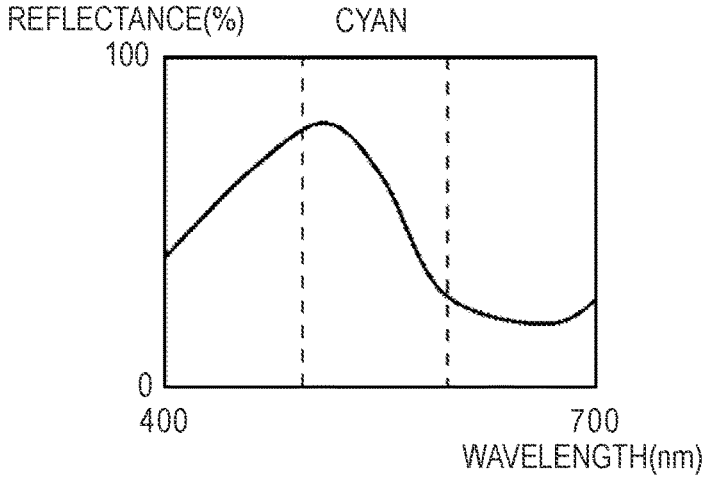
FIGS. 3A, 3B and 3C are graphs illustrating spectral reflectance of liquids to be ejected.
Figure 3B:
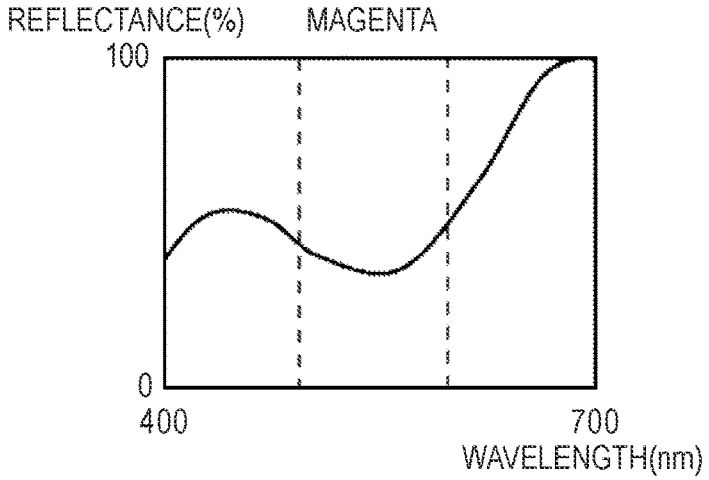
Figure 3C:
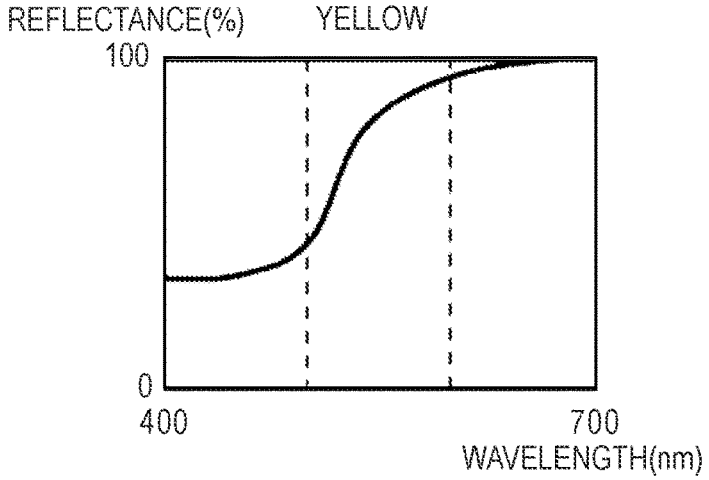

In FIGS. 3A, 3B, and 3C, spectral reflectance in a visible light region (wavelength region of 400 nm or more and 700 nm or less in this example) of the liquid of each color that is ejected from the liquid ejection head 10 as a liquid to be ejected is illustrated with the horizontal axis representing the wavelength and the vertical axis representing the reflectance. FIG. 3A illustrates the spectral reflectance of the cyan liquid, FIG. 3B illustrates the spectral reflectance of the magenta liquid, and FIG. 3C illustrates the spectral reflectance of the yellow liquid. Although not illustrated here, the reflectance of the black liquid is close to 0 at any wavelength in the visible light region and is lower than the reflectance of any of the cyan, magenta and yellow liquids at any wavelength in the visible light region. In the liquid ejection head 10 according to the present disclosure, when liquids of different colors flow in adjacent flow paths, a flow path in which higher pressure is to be applied to a liquid is determined based on the average value of spectral reflectance of each of the liquids at wavelengths in the visible light region. The average value of the spectral reflectance can be calculated, for example, by acquiring spectral reflectance at predetermined wavelength intervals (for example, 10 nm or less) and averaging the spectral reflectance. Pressure to be applied to a liquid in a flow path for the liquid having higher average spectral reflectance is set higher than pressure applied to a liquid having lower average spectral reflectance. For example, it is considered that a first flow path and a second flow path are adjacent to each other in the liquid ejection head 10, and a first liquid having relatively low average spectral reflectance at a wavelength in the visible light region is caused to flow through the first flow path, and a second liquid having relatively high average spectral reflectance at the wavelength in the visible light region is caused to flow through the second flow path. In this case, when pressure applied to the second liquid in the second flow path is set higher than pressure applied to the first liquid in the first flow path, the second liquid flows unilaterally from the second flow path toward the first flow path. As a result, the second liquid having the high average spectral reflectance, for example, a liquid having higher luminance, is mixed with the first liquid having the low average spectral reflectance, for example, a liquid having lower luminance. Even when a small amount of liquid having relatively high average spectral reflectance is mixed with a liquid having relatively low average spectral reflectance, a perceptible change in a recorded image is small, and a decrease in image quality can be suppressed. In the example illustrated in FIGS. 2A and 2B, the black liquid corresponds to the first liquid, the cyan liquid corresponds to the second liquid, the flow path 16*b* corresponds to the first flow path, and the flow path 16*a* corresponds to the second flow path. As a method of operating the liquid ejection head 10, the pressure applied to the second liquid in the liquid chamber of the flow path through which the second liquid having a higher average value of spectral reflectance at wavelengths in the visible light region than that of the first liquid flows may be set higher than the pressure applied to the first liquid in the liquid chamber of the flow path through which the first liquid flows.

There are several methods of setting the pressure applied to the second liquid in the second flow path to be higher than the pressure applied to the first liquid in the first flow path. As will be described later, a pressure generator may be provided in a liquid ejection apparatus including the liquid ejection head 10 and may be connected to each of the flow paths 16*a* to 16*e* of the liquid ejection head 10, and the liquids to be ejected, for which pressure has been adjusted by the pressure generator, may be supplied to the liquid ejection head 10. Alternatively, a first buffer tank that communicates with the first flow path and stores the first liquid and a second buffer tank that communicates with the second flow path and stores the second liquid may be provided, and the water head of the second buffer tank may be higher than that of the first buffer tank.

The dimensions and shapes of the flow paths 16*a* to 16*e* are the same, and when the liquids are supplied to the flow paths 16*a* to 16*e* at the same supply pressure, a difference between the pressures applied to the liquids in the liquid chambers 14*a* to 14*e* can be provided by changing the viscosities of the liquids. In the case illustrated in FIGS. 2A and 2B, it is assumed that the black liquid is supplied to the flow path 16*b* which is the first flow path, and the cyan liquid is supplied to the flow path 16*a* which is the second flow path. A decrease in the pressure due to the flow increases as the viscosity increases. Therefore, when the viscosity of the black liquid is higher than that of the cyan liquid, and the pressure in the liquid chamber 14*a* is compared with the pressure in the liquid chamber 14*b*, the pressure applied to the black liquid in the liquid chamber 14*b* is lower than the pressure applied to the cyan liquid in the liquid chamber 14*a*. As a result, the cyan liquid flows in one direction from the liquid chamber 14*a* toward the liquid chamber 14*b* through the defect 18. In the case of providing a difference in viscosity between the liquids flowing through the flow paths 16*a* and 16*b*, the viscosity of each liquid is adjusted such that the pressure difference between the adjacent liquid chambers 14*a* and 14*b* is about 100 Pa. In the case of varying the viscosity for each liquid, there is a method of changing the viscosity of each liquid by controlling heat to be applied to the liquids in the flow paths 16*a* to 16*e* or the upstream thereof other than the method of using liquid materials having different viscosities. Furthermore, a difference in viscosity between the liquids may be generated by another mechanism or configuration.

Figure 4:
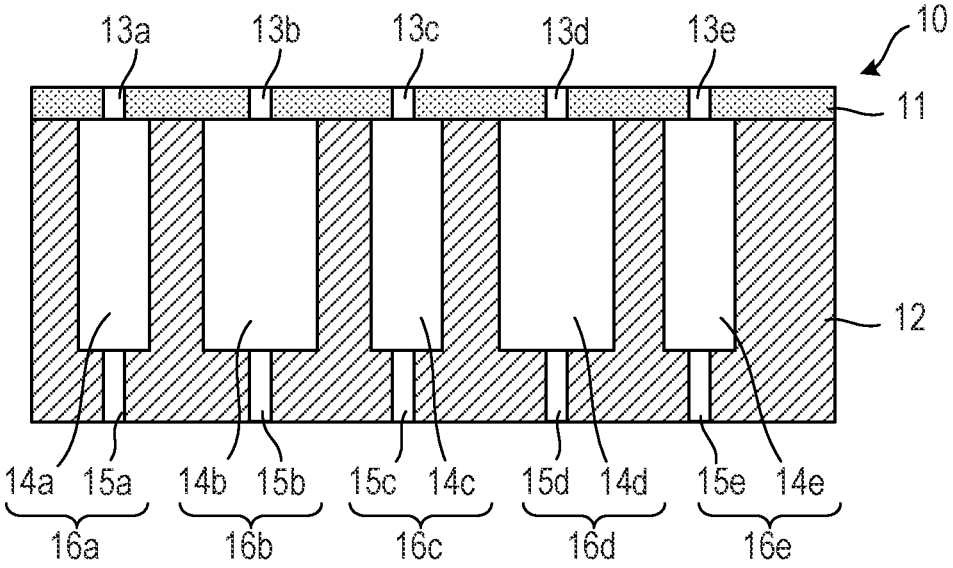
FIG. 4 is a schematic end view illustrating another example of the liquid ejection head.

When the liquids are supplied to the flow paths 16*a* to 16*e* at the same supply pressure, a difference between the pressures applied to the liquids in the liquid chambers 14*a* to 14*e* can be provided by changing the flow velocities in the flow paths 16*a* to 16*e*. As a method of changing the flow velocities in the flow paths 16*a* to 16*e*, there is a method of changing the cross-sectional areas of the flow paths 16*a* to 16*e*, particularly, the cross-sectional areas at positions where the flow paths 16*a* to 16*e* communicate with the ejection orifices 13*a* to 13*e*, respectively. The cross-sectional area of each flow path refers to a cross-sectional area taken along a plane perpendicular to the flow direction of the liquid in the flow path. FIG. 4 illustrates the liquid ejection head 10 illustrated in FIG. 1 in which a difference in cross-sectional area between the flow paths 16*a* to 16*e* is provided. By providing the difference in cross-sectional area, a difference also occurs between the volumes of the liquid chambers 14*a* to 14*e*. More specifically, in the example illustrated in FIG. 4, as compared with the example illustrated in FIG. 1, in the flow paths 16*b* and 16*d* for the black liquid, the widths of the liquid chambers 14*b* and 14*d* provided in the portions communicating with the ejection orifices 13*b* and 13*d* are increased to increase the cross-sectional areas as the flow paths. When the flow path cross-sectional areas in the liquid chambers 14*b* and 14*d* are made wider by about 45% than the flow path cross-sectional areas in the liquid chambers 14*a*, 14*c*, and 14*e*, the flow velocities are reduced by about half, which bring about an effect of reducing the pressure by about 100 Pa.

Furthermore, by changing the flow resistance in the flow paths 16*a* to 16*e*, it is possible to provide a difference between the pressures applied to the liquids in the flow paths 16*a* to 16*e*, particularly the liquid chambers 14*a* to 14*e*. As a method of changing the flow resistance, there are a method of changing the lengths of the liquid chambers 14*a* to 14*e* in the flow direction of the liquids in the liquid chambers 14*a* to 14*e*, a method of forming irregularities on the inner wall surfaces of the flow paths 16*a* to 16*e*, and the like. Any method of changing the flow resistance of each flow path is included in the scope of the present disclosure.

In the liquid ejection head 10 illustrated in FIG. 1, the ejection orifice forming member 11 and the liquid chamber forming member 12 may be integrally formed in a single member, or may be formed by joining different members or the same member. The liquid chamber forming member 12 itself may be formed by joining a plurality of members. When the ejection orifice forming member 11 and the liquid chamber forming member 12 are to be joined, an adhesive or the like may be applied to the interface between the ejection orifice forming member 11 and the liquid chamber forming member 12 to join the ejection orifice forming member 11 and the liquid chamber forming member 12 to each other to form an integrated joined product, or the ejection orifice forming member 11 and the liquid chamber forming member 12 may be joined to each other by causing a chemical bond at the interface by direct joining. Furthermore, in the liquid ejection head 10 according to the present disclosure, a joint interface between the plate-shaped members may be present other than the joint interface between the ejection orifice forming member 11 and the liquid chamber forming member 12. By applying the present disclosure, it is also possible to suppress a decrease in image quality due to mixing of liquids in adjacent flow paths via a defect existing at a joint interface other than the joint interface between the ejection orifice forming member 11 and the liquid chamber forming member 12. Further, by applying the present disclosure, it is also possible to suppress a decrease in image quality due to mixing of liquids via a defect formed in a partition wall between adjacent flow paths at a position other than the joint interface.

Figure 5:
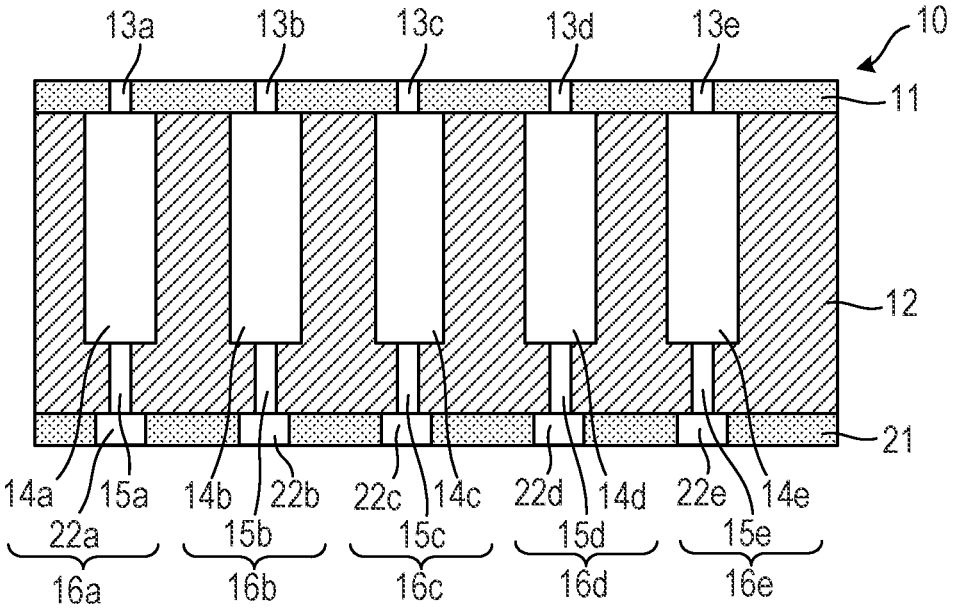
FIG. 5 is a schematic cross-sectional view illustrating another example of the liquid ejection head.

The liquid ejection head 10 illustrated in FIG. 5 is obtained by joining a cover plate 21, which is a plate-shaped member, to a surface of the liquid chamber forming member 12 on a side opposite to the joint interface with the ejection orifice forming member 11 in the liquid ejection head 10 illustrated in FIG. 1. In the cover plate 21, openings 22*a* to 22*e* communicating with the supply paths 15*a* to 15*e* are formed as through holes in order to enable the liquids to be supplied to the liquid chambers 14*a* to 16*e*. The openings 22*a* to 22*e* constitute parts of the flow paths 16*a* to 16*e*, respectively. The cover plate 21 may be formed of a member that is different from or the same as the liquid chamber forming member 12. In the case where the flow rates in the flow paths 16*a* to 16*e* are changed to change the pressure applied to the liquids in the liquid chambers 14*a* to 14*e*, it is possible to change the flow rates in the flow paths 16*a* to 16*e* by making the cross-sectional areas of the openings 22*a* to 22*e* different while keeping the dimensions of the liquid chambers 14*a* to 14*e* the same.

In the liquid ejection head 10 described with reference to FIGS. 1 to 5, the five flow paths 16*a* to 16*e* are used, and the black liquid flows through the two flow paths 16*b* and 16*d* among the flow paths 16*a* to 16*e*. However, the arrangement of the flow paths in the liquid ejection head 10 is not limited thereto. In the liquid ejection head 10 illustrated in FIG. 6, the four flow paths 16*a* to 16*d* are provided. Regarding the four flow paths 16*a* to 16*d*, a yellow liquid is supplied to the flow path 16*a*, a cyan liquid is supplied to the flow path 16*b*, a magenta liquid is supplied to the flow path 16*c*, and a black liquid is supplied to the flow path 16*d*. Also in the liquid ejection head 10, the pressure to be applied to the liquid in each of the flow paths 16*a* to 16*d* is set according to the case where an effect when a small amount of one of liquids of two different colors that flow in adjacent flow paths is mixed into the other liquid is small. The liquid having the smallest effect on a decrease in image quality as the liquid to be mixed into the other liquid is the yellow liquid, the liquid having the second smallest effect is the cyan liquid, the liquid having the third smallest effect is the magenta liquid, and the liquid having the largest effect is the black liquid. Therefore, when the pressure applied to the liquids in the liquid chambers 14*a* to 14*d* is $P_a$, $P_b$, $P_c$, and $P_d$, respectively, $P_a>P_b>P_c>P_d$ is satisfied. Since the pressure is set in this manner, even when there is a defect through which flow paths communicate with each other, it is possible to perform control such that the liquids flow only from the liquid chamber 14*a* to the liquid chamber 14*b*, from the liquid chamber 14*b* to the liquid chamber 14*c*, and from the liquid chamber 14*c* to the liquid chamber 14*d*. With this configuration, a decrease in image quality due to mixing of a liquid among liquids of different colors with another liquid among the liquids can be minimized.

Figure 6:
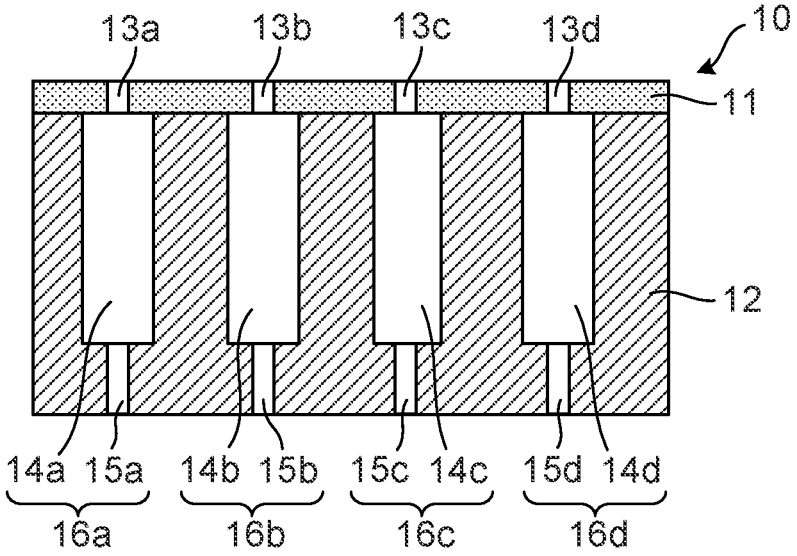
FIG. 6 is a schematic cross-sectional view illustrating another example of the liquid ejection head.

The example illustrated in FIG. 6 indicates the case where liquids of four different colors are supplied to the four flow paths 16*a* to 16*d*, respectively. However, even in the case where the number of flow paths is increased in accordance with an increase in the types of liquids, a decrease in image quality can be minimized by setting pressure in a similar manner. A method of setting pressure when there are three or more flow paths will be generally described as follows. The case is considered where the first flow path through which the first liquid flows and the second flow path through which the second liquid flows are adjacent to each other, the third flow path is disposed adjacent to the second flow path on the opposite side of the first flow path with the second flow path interposed therebetween, and the third liquid flows through the third flow path. It is assumed that the second liquid has higher average spectral reflectance at wavelengths in the visible light region than that of the first liquid, and that the third liquid has higher average spectral reflectance at the wavelengths in the visible light region than that of the second liquid. In this case, the pressure applied to the first liquid in the first flow path is set lower than the pressure applied to the second liquid in the second flow path, and the pressure applied to the second liquid in the second flow path is set lower than the pressure applied to the third liquid in the third flow path. In the example illustrated in FIG. 6, when attention is paid to the flow paths 16*a* to 16*c*, the flow path 16*a* through which the yellow liquid flows corresponds to the third flow path, the flow path 16*b* through which the cyan liquid flows corresponds to the second flow path, and the flow path 16*c* through which the magenta liquid flows corresponds to the first flow path.

As a method of setting such a pressure difference between the first to third flow paths, for example, there is a method of providing first to third buffer tanks respectively communicating with the first to third flow paths so as to provide a difference between the water heads of the buffer tanks. In this case, the water head of the second buffer tank is set higher than that of the first buffer tank, and the water head of the third buffer tank is set higher than that of the second buffer tank. Alternatively, the cross-sectional area of the first flow path may be set larger than the cross-sectional area of the second flow path, and the cross-sectional area of the second flow path may be set larger than the cross-sectional area of the third flow path to form a pressure difference between the flow paths. Furthermore, the viscosity of the first liquid may be made higher than the viscosity of the second liquid, and the viscosity of the second liquid may be made higher than the viscosity of the third liquid to form a pressure difference between the flow paths.

Second Embodiment

Figure 7A:
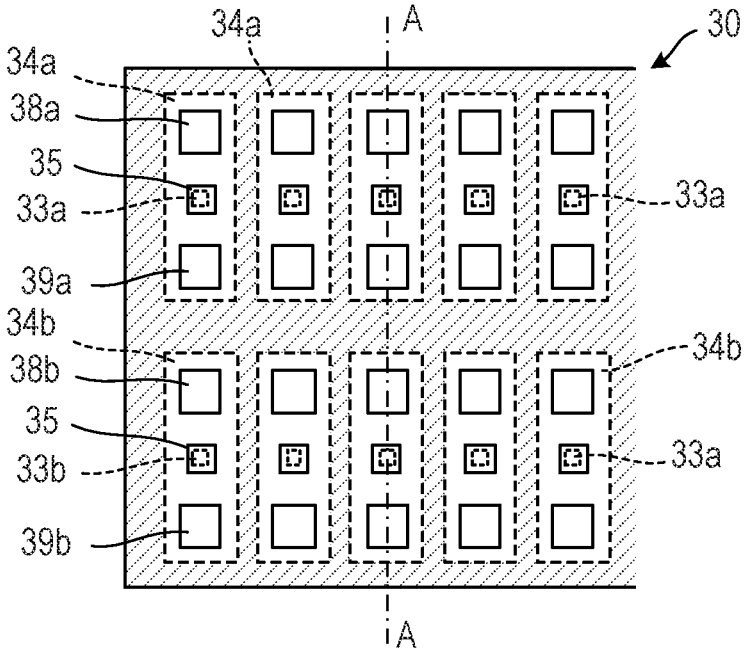
FIGS. 7A and 7B are diagrams illustrating a liquid ejection head according to a second embodiment.
Figure 7B:
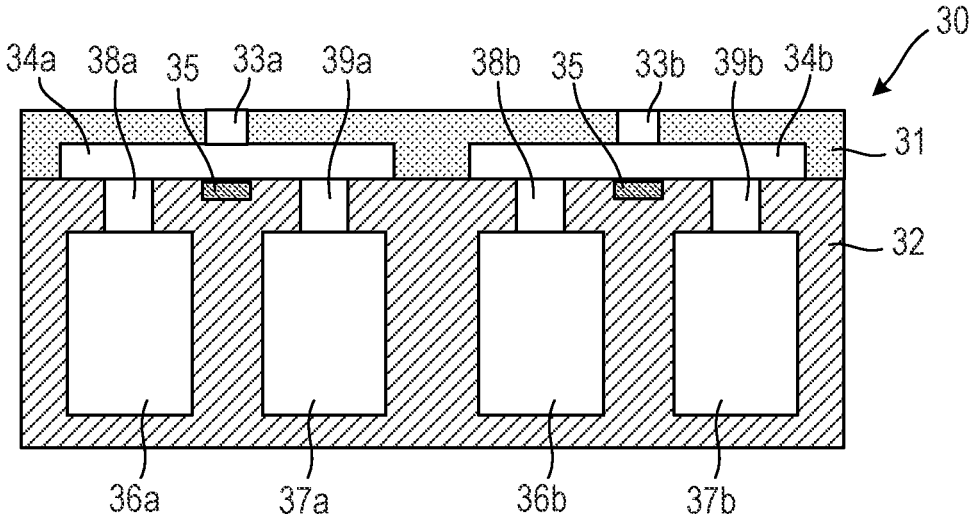

FIGS. 7A and 7B illustrate a liquid ejection head 30 according to a second embodiment of the present disclosure. The liquid ejection head 30 is formed by laminating and joining an ejection orifice forming member 31 and a liquid chamber forming member 32, both of which are plate-shaped members, and is of a type in which a liquid to be ejected circulates. In the drawing, a region where ejection orifices 33*a* and 33*b* for liquids of two different colors are provided is illustrated. FIG. 7A is a plan view illustrating the liquid ejection head 30 according to the present embodiment, and FIG. 7B is a cross-sectional view taken along line A-A of FIG. 7A. In FIG. 7A, in order to facilitate understanding of the structure of the liquid ejection head 30, the ejection orifice forming member 31 is indicated by a broken line, and the liquid chamber forming member 32 is indicated by a solid line when the ejection orifice forming member 31 is absent. A hatched portion in FIG. 7A indicates a region where the ejection orifice forming member 31 and the liquid chamber forming member 32 are joined. The plurality of ejection orifices 33*a* for a liquid of one color is provided and arranged in one row in the horizontal direction in FIG. 7A to form an ejection orifice array. Similarly, a plurality of ejection orifices 33*b* for the liquid of the other color is also provided and arranged in one row to form an ejection orifice array.

When attention is paid to each ejection orifice 33*a*, an elongated recess communicating with the ejection orifice 33*a* is formed for each ejection orifice 33*a* in the surface of the ejection orifice forming member 31 facing the liquid chamber forming member 32 at the position where the ejection orifice 33*a* is provided. This recess constitutes a pressure chamber 34*a* through which the liquid to be ejected can pass when the ejection orifice forming member 31 and the liquid chamber forming member 32 are joined. On the surface of the liquid chamber forming member 32 at a position facing the ejection orifice 33*a* communicating with the pressure chamber 34*a*, an energy-generating element 35 such as an electrothermal converter that generates energy for ejecting a liquid from the ejection orifice 33*a* is provided. Supply ports 38*a* and 39*a* are provided in the liquid chamber forming member 32 so as to correspond to both ends of the pressure chamber 34*a* in the longitudinal direction of the pressure chamber 34*a*. The supply ports 38*a* and 39*a* communicate with individual liquid chambers 36*a* and 37*a* formed in the liquid chamber forming member 32. When the liquid is not ejected from the ejection orifice 33*a*, the liquid flows from the individual liquid chamber 36*a* to the individual liquid chamber 37*a* through the supply port 38*a*, the pressure chamber 34*a*, and the supply port 39*a*. Then, the liquid that has flowed into the individual liquid chamber 37*a* is recovered via a pipe provided outside the liquid ejection head 30, and is re-supplied to the individual liquid chamber 36*a* via a tank or the like. In an overall liquid ejection apparatus including the liquid ejection head 30, the liquid to be ejected circulates. When the energy-generating element 35 is driven, a part of the liquid in the pressure chamber 34*a* is ejected from the ejection orifice 33*a*, and the liquid flows from the individual liquid chambers 36*a* and 37*a* to the pressure chamber 34*a* through the supply ports 38*a* and 39*a* so as to supplement the ejected liquid. The pressure in the individual liquid chambers 36*a* and 37*a* is kept constant. The individual liquid chamber 36*a* and the supply port 38*a* constitute one flow path 4 communicating with the ejection orifice 33*a*, and the individual liquid chamber 37*a* and the supply port 39*a* also constitute one flow path communicating with the same ejection orifice 33*a*. Similarly, a pressure chamber 34*b*, an energy-generating element 35, individual liquid chambers 36*b* and 37*b*, and supply ports 38*b* and 39*b* are provided corresponding to each ejection orifice 33*b*.

Assuming that the flow resistance of the pressure chamber 34*a* and the supply ports 38*a* and 39*a* is low and that the liquid is supplied from a buffer tank (not illustrated) to the individual liquid chamber 36*a*, it may be considered that the pressure applied to the liquid in both the individual liquid chambers 36*a* and 37*a* corresponding to the ejection orifice 33*a* is the same. Similarly, it may be considered that the pressure applied to the liquid in both the individual liquid chambers 36*b* and 37*b* corresponding to the ejection orifice 33*b* is the same. Here, the case where the cyan liquid is ejected from the ejection orifice 33*a* and the black liquid is ejected from the ejection orifice 33*b* will be considered. The flow path including the individual liquid chamber 37*a* and the supply port 39*a* and the flow path including the individual liquid chamber 36*b* and the supply port 38*b* are adjacent in the liquid chamber forming member 32, and are flow paths through which the liquids of the different colors flow. In the present embodiment, as in the case of the first embodiment, the pressure applied to the liquid in the flow path through which the cyan liquid flows is set higher than the pressure applied to the liquid in the flow path through which the black liquid flows. As a result, even if there is a defect that allows both flow paths to communicate with each other, a small amount of cyan liquid flows from the individual liquid chamber 37*a* in which higher pressure is applied to the cyan liquid to the individual liquid chamber 36*b* in which lower pressure is applied to the black liquid such that the small amount of cyan liquid is mixed into the black liquid.

It is assumed that there is a defect having a width of 1 μm and a height of 0.5 μm through which the flow path including the individual liquid chamber 37*a* and the supply port 39*a* communicates with the flow path including the individual liquid chamber 36*b* and the supply port 38*b*, specifically, through which the individual liquid chamber 37*a* communicates with the individual liquid chamber 36*b*. When the pressure applied to the liquid in the individual liquid chamber 37*a* is set higher than the pressure applied to the liquid in the individual liquid chamber 36*b* by 10 Pa, the cyan liquid in the individual liquid chamber 37*a* flows into the black liquid in the individual liquid chamber 36*b* at a rate of about 130 pL per 24 hours. The black liquid does not flow in the opposite direction. The amount of about 130 pL of the liquid flowing for 24 hours is, for example, about 0.005% of the volume of the individual liquid chamber 36*b*, and even if the black liquid into which the cyan liquid flows is ejected from the ejection orifice 33*b* to perform recording, there is no effect on the quality of a recorded image. By further reducing the pressure difference between the individual liquid chambers 37*a* and 36*b* to a level lower than 10 Pa, the amount of the cyan liquid to be mixed into the black liquid can be reduced. If the set pressure difference is too small, there is a possibility that the liquid may flow in the opposite direction from the individual liquid chamber 37*a* to the individual liquid chamber 36*b* due to pressure fluctuation that can occur in the individual liquid chambers 37*a* and 36*b*. In the case of a liquid ejection head of a type in which a liquid circulates, it is necessary to set a pressure difference between adjacent flow paths for liquids of different colors to approximately 3000 Pa or less so as not to interfere with refilling of a pressure chamber with the liquid after the ejection of the liquid.

Although the liquid ejection head 30 that includes the ejection orifice array including the ejection orifices 33*a* and the ejection orifice array including the ejection orifices 33*b* and ejects liquids of two different colors has been described above, the liquid ejection head according to the second embodiment can be configured to eject liquids of three or more colors. For example, the liquid ejection head according to the second embodiment can be obtained by providing pressure chambers communicating with the ejection orifices such that the liquids circulate in the pressure chambers in the liquid ejection head illustrated in FIGS. 1, 3A, 3B, 3C, 4, and 5. In the second embodiment, as in the case of the first embodiment, examples of the method of setting a pressure difference between the flow paths include a method using a pressure generator, a method using a difference between water heads in buffer tanks, a method using a difference in viscosity between liquids, and a method using a difference between cross-sectional areas of the flow paths or a difference between flow resistance of the flow paths.

Liquid Ejection Apparatus

Figure 8:
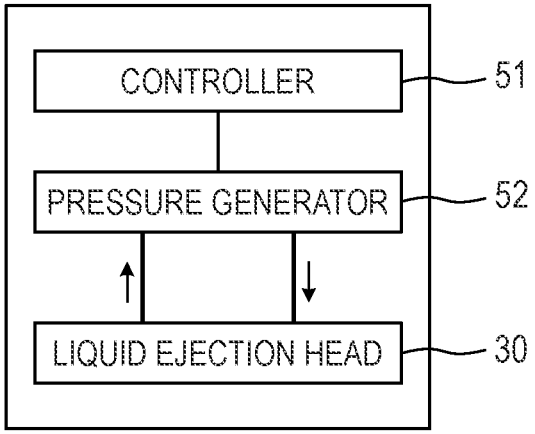
FIG. 8 is a diagram for explaining a liquid ejection apparatus.

FIG. 8 is a diagram for explaining the liquid ejection apparatus including the liquid ejection head according to the present disclosure. The liquid ejection apparatus includes the liquid ejection head 30 according to the second embodiment and includes a controller 51 as a control unit and a pressure generator 52 that is controlled by the controller 51. The pressure generator 52 is connected to the respective flow paths of the liquid ejection head 30 to supply liquids to be ejected to the respective flow paths, and can simultaneously generate pressure different for each of the flow paths. The liquid of each color is supplied from the pressure generator 52 to the liquid ejection head 30, and the liquid that has not been ejected by the liquid ejection head 30 returns to the pressure generator 52, whereby the liquid circulates between the pressure generator 52 and the liquid ejection head 30. The controller 51 controls the pressure generator 52 to change supply pressure to be applied to the liquids to be supplied to the liquid ejection head 30, thereby generating a pressure difference between adjacent flow paths in the liquid ejection head 30 as described above. The pressure generator 52 may include a buffer tank group (not illustrated) communicating with the flow paths for the liquids of the respective colors, and generate a difference between the supply pressures to be applied to the liquids due to a difference between the water heads in the buffer tanks. Also in the liquid ejection apparatus using the liquid ejection head 10 according to the first embodiment, the pressure generator 52 in which the supply pressure to be applied to the liquids is controlled by the controller 51 is provided, and the liquid of each color can be supplied from the pressure generator 52 to each flow path of the liquid ejection head 10.

The liquid ejection heads 10 and 30 according to the respective embodiments are intended to suppress a decrease in image quality by setting a pressure difference between flow paths when a defect communicating with adjacent flow paths through which liquids of different colors flow is present between the flow paths. In this case, the defect can be closed using the liquid to be ejected, that is, a liquid to be ejected. Hereinafter, the closure of the defect using the liquid to be ejected will be described.

Figure 9:
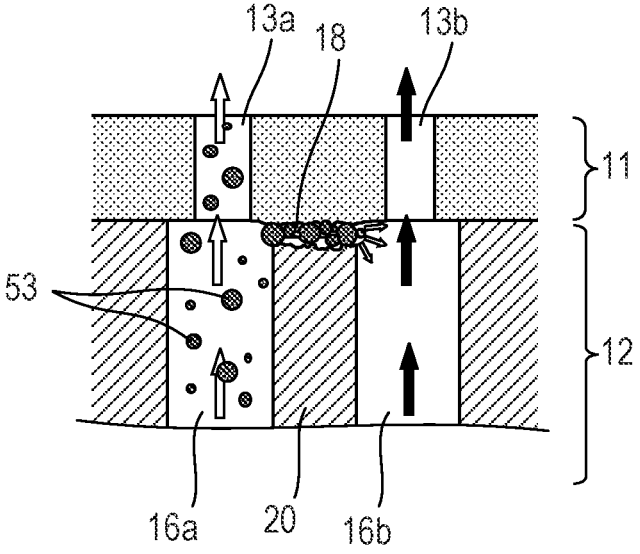
FIG. 9 is a schematic cross-sectional view illustrating liquids to be ejected.

FIG. 9 illustrates an example of a method of closing the defect using the liquid to be ejected. Here, as in the case illustrated in FIGS. 3A, 3B, and 3C, it is assumed that the flow paths 16*a* and 16*b* are adjacent to each other with the partition wall 20 interposed therebetween, and the defect 18 through which the flow paths 16*a* and 16*b* communicate with each other is formed at the joint interface between the ejection orifice forming member 11 and the liquid chamber forming member 12. The liquid flowing through the flow path 16*a* is a yellow liquid, the liquid flowing through the flow path 16*b* is a black liquid, and the pressure applied to the liquid in the flow path 16*a* is higher than that in the flow path 16*b*. The liquid supplied to the flow path 16*a* in which higher pressure is applied contains filler particles 53 having a size smaller than the diameter of the ejection orifice 13*a* in a state in which the filler particles 53 are dispersed in the liquid. The filler particles 53 are made of, for example, a transparent polymer, has a diameter of, for example, 1 nm or more and 5 μm or less, and is used by mixing the filler particles 53 of various sizes. Since the pressure applied to the liquid in the flow path 16*a* is higher than that in the flow path 16*b*, the liquid containing the filler particles 53 tends to flow from the flow path 16*a* toward the flow path 16*b* through the defect 18. In this case, the filler particles 53 dispersed in the liquid are caught and deposited on the side wall of the defect 18. As a result, the defect 18 is closed, and the liquid in the flow path 16*a* is prevented from being continuously mixed with the liquid in the flow path 16*b*. Since the filler particles 53 of various sizes are contained in the liquid, the liquid can be prevented from flowing through gaps between the deposited filler particles 53, and defects 18 of various sizes and shapes can be closed. The filler particles 53 that have not involved in the closure of the defect 18 are ejected from the ejection orifices 13*a*.

Figure 10:
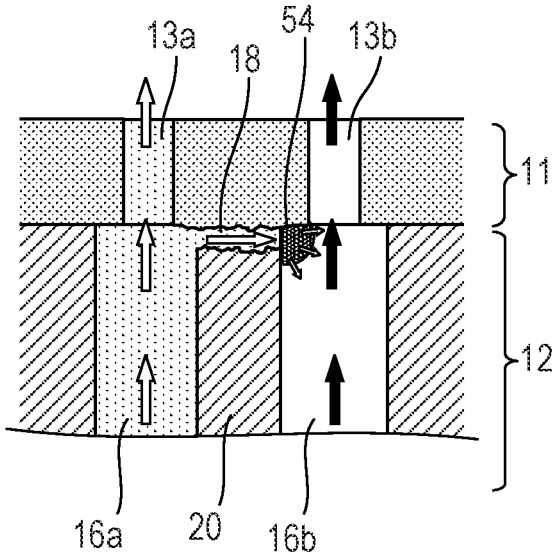
FIG. 10 is a schematic cross-sectional view for explaining the liquids to be ejected.

FIG. 10 illustrates another example of the method of closing the defect using the liquid to be ejected. The example illustrated in FIG. 10 indicates the case where, in the example illustrated in FIG. 9, in place of the filler particles 53, a curable material is contained in the liquid flowing through the flow path 16*a* on the high pressure side, and a curing initiator is contained in the liquid flowing through the flow path 16*b* on the low pressure side. The curing initiator contained in the liquid flowing through the flow path 16*b* is a chemical agent that starts curing of the curing initiator contained in the liquid flowing through the flow path 16*a*. As an example, the curable material is a polymer having polymerizability, and the curing initiator is a polymerization initiator corresponding to the polymer. When the liquid containing the curable material flows into the flow path 16*b* from the flow path 16*a* through the defect 18, the curable material starts to be cured by the action of the curing initiator contained in the liquid in the flow path 16*b* at the time of the flow into the flow path 16*b*. As a result, a cured product 54 is formed near the exit of the defect 18 on the flow path 16*b* side, and the exit of the defect 18 is closed, whereby the defect 18 is closed. The curable material that has not contributed to the formation of the cured product 54 is ejected from the ejection orifice 13*a*, and the curing initiator that has not contributed to the formation of the cured product 54 is ejected from the ejection orifice 13*b*.

Here, the case of closing the defect 18 formed between the two adjacent flow paths 16*a* and 16*b* has been described with reference to FIGS. 9 and 10. The method of closing the defect using the liquid to be ejected as described here can be performed for the liquid ejection head described above in each of the embodiments including more flow paths.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-200522, filed Dec. 2, 2020, which is hereby incorporated by reference herein in its entirety.

What is claimed is:

1. A liquid ejection head comprising:

a plurality of flow paths, wherein the plurality of flow paths includes a first flow path through which a first liquid is to flow, and a second flow path disposed adjacent to the first flow path and through which a second liquid, having higher average spectral reflectance at a wavelength in a visible light region than the first liquid, is to flow, and wherein, when pressure is applied to the first liquid, the pressure applied to the first liquid in the first flow path is lower than pressure applied to the second liquid in the second flow path.

2. The liquid ejection head according to claim 1, wherein a cross-sectional area of the first flow path is larger than a cross-sectional area of the second flow path.

3. The liquid ejection head according to claim 1, wherein a viscosity of the first liquid is higher than a viscosity of the second liquid.

4. The liquid ejection head according to claim 1, wherein the second liquid contains filler particles configured to fill a defect formed between the first flow path and the second flow path.

5. The liquid ejection head according to claim 1, wherein the second liquid contains a curable material, and the first liquid contains a curing initiator configured to start curing of the curable material.

6. The liquid ejection head according to claim 1, further comprising:

a first buffer tank configured to communicate with the first flow path; and a second buffer tank configured to have a water head higher than that of the first buffer tank and to communicate with the second flow path.

7. The liquid ejection head according to claim 1, wherein the plurality of flow paths further includes a third flow path which is disposed on an opposite side of the first flow path with the second flow path interposed between the first flow path and the third flow path and is adjacent to the second flow path and through which a third liquid, having higher average spectral reflectance at the wavelength in the visible light region than the second liquid, is to flow, and wherein the pressure applied to the second liquid in the second flow path is lower than pressure applied to the third liquid in the third flow path.

8. The liquid ejection head according to claim 7, further comprising:

a first buffer tank configured to communicate with the first flow path;

a second buffer tank configured to have a water head higher than that of the first buffer tank and to communicate with the second flow path; and a third buffer tank configured to have a water head higher than that of the second buffer tank and to communicate with the third flow path.

9. The liquid ejection head according to claim 7, wherein a cross-sectional area of the first flow path is larger than a cross-sectional area of the second flow path, and the cross-sectional area of the second flow path is larger than a cross-sectional area of the third flow path.

10. The liquid ejection head according to claim 7, wherein a viscosity of the first liquid is higher than a viscosity of the second liquid, and the viscosity of the second liquid is higher than a viscosity of the third liquid.

11. The liquid ejection head according to claim 1, wherein a plurality of plate-shaped members is laminated and joined, and the plurality of flow paths is in contact with a joint interface between the plurality of plate-shaped members.

12. A liquid ejection apparatus comprising:

the liquid ejection head according to claim 1;

a pressure generator connected to the plurality of flow paths and capable of generating pressure that is different for each of the plurality of flow paths; and a control unit configured to control the pressure generator.

13. The liquid ejection apparatus according to claim 12, wherein the pressure generator includes a plurality of buffer tanks.

14. A method of operating a liquid ejection head including a plurality of flow paths and a liquid chamber, wherein the liquid chamber is configured to communicate with an ejection orifice for each of the plurality flow paths and to hold a liquid, the method comprising:

causing a first liquid to flow in one of two adjacent flow paths;

causing a second liquid, having higher average spectral reflectance at a wavelength in a visible light region than the first liquid, to flow in the other of the two adjacent flow paths; and setting pressure applied to the second liquid held in the liquid chamber of the flow path through which the second liquid flows such that, when the first and second liquids are caused to flow, the pressure applied to the second liquid is higher than pressure applied to the first liquid held in the liquid chamber of the flow path through which the first liquid flows.

15. The method according to claim 14, wherein a viscosity of the first liquid is higher than a viscosity of the second liquid.

16. The method according to claim 14, further comprising filling a defect formed between the first flow path and the second flow path using filler particles contained in the second liquid.

17. The method according to claim 14, further comprising staring curing of a curable material contained in the second liquid using a curing initiator contained in the first liquid.

18. A method for a liquid ejection head having a plurality of flow paths, including a first flow path and a second flow path disposed adjacent to the first flow path, the method comprising:

flowing a first liquid through the first flow path and flowing a second liquid through the second flow path, wherein the second liquid has a higher average spectral reflectance at a wavelength in a visible light region than the first liquid; and applying pressure to the first liquid such that the pressure applied to the first liquid in the first flow path is lower than pressure applied to the second liquid in the second flow path.

19. A non-transitory computer-readable storage medium storing a program to cause a computer to perform a method for a liquid ejection head having a plurality of flow paths, including a first flow path and a second flow path disposed adjacent to the first flow path, the method comprising:

flowing a first liquid through the first flow path and flowing a second liquid through the second flow path, wherein the second liquid has a higher average spectral reflectance at a wavelength in a visible light region than the first liquid; and applying pressure to the first liquid such that the pressure applied to the first liquid in the first flow path is lower than pressure applied to the second liquid in the second flow path.

* * * * *